US008512102B2

(12) United States Patent
Pei

(10) Patent No.: US 8,512,102 B2
(45) Date of Patent: Aug. 20, 2013

(54) SANDBLASTING APPARATUS

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 380 days.

(21) Appl. No.: 12/954,618

(22) Filed: Nov. 25, 2010

(65) Prior Publication Data

US 2012/0064807 A1 Mar. 15, 2012

(30) Foreign Application Priority Data

Sep. 10, 2010 (TW) ..... 99130789

(51) Int. Cl.
*B24C 3/32* (2006.01)

(52) U.S. Cl.
USPC ..... 451/89; 451/37; 451/65; 451/66; 451/80; 451/82

(58) Field of Classification Search
USPC ..... 451/37–40, 57, 65, 66, 80, 82, 84, 451/89
See application file for complete search history.

(56) References Cited

U.S. PATENT DOCUMENTS

| | | | | | |
|---|---|---|---|---|---|
| 2,337,048 | A * | 12/1943 | Huyett et al. | 451/81 |
| 2,414,923 | A * | 1/1947 | Batcheller | 427/543 |
| 2,436,928 | A * | 3/1948 | Kempe | 123/188.3 |
| 3,041,787 | A * | 7/1962 | Schnetzer | 451/82 |
| 3,362,109 | A * | 1/1968 | Wallace | 451/38 |
| 3,696,565 | A * | 10/1972 | Claeys | 451/39 |
| 3,813,817 | A * | 6/1974 | Haberlin | 451/82 |
| 4,018,006 | A * | 4/1977 | Moelders | 451/82 |
| 5,107,629 | A * | 4/1992 | Boyd et al. | 451/38 |
| 5,315,793 | A * | 5/1994 | Peterson et al. | 451/2 |
| 5,332,643 | A * | 7/1994 | Harada et al. | 430/127 |
| 5,417,608 | A * | 5/1995 | Elliott | 451/81 |
| 5,468,175 | A * | 11/1995 | Nilen | 451/87 |
| 5,586,927 | A * | 12/1996 | Herbert | 451/88 |
| 5,709,587 | A * | 1/1998 | Shaffer | 451/38 |
| 5,766,061 | A * | 6/1998 | Bowers | 451/89 |
| 5,836,809 | A * | 11/1998 | Kosic | 451/89 |
| 5,839,945 | A * | 11/1998 | Elliott | 451/82 |
| 6,315,646 | B1 * | 11/2001 | Hoyashita | 451/65 |
| 6,364,748 | B1 * | 4/2002 | Zwicker et al. | 451/38 |
| 6,719,612 | B2 * | 4/2004 | Visaisouk et al. | 451/39 |
| 2009/0081928 | A1 * | 3/2009 | Fujiwara et al. | 451/38 |
| 2012/0315827 | A1 * | 12/2012 | Edman et al. | 451/38 |

* cited by examiner

*Primary Examiner* — George Nguyen
(74) *Attorney, Agent, or Firm* — Altis Law Group, Inc.

(57) ABSTRACT

A sandblasting apparatus includes a chamber defining a cavity, a support assembly received in the cavity, a first and a second sandblasting assemblies. The support assembly includes a number of pairs of elongated support plates for holding a plate-shaped workpiece therebetween. The support plates are moveable along a vertical direction and a first horizontal direction. The first sandblasting assembly is configured for spraying sand downwardly toward the plate-shaped workpiece so as to cut the plate-shaped workpiece into a number of workpiece strips. The second sandblasting assembly is configured for spraying sand toward the workpiece strips along a second horizontal direction perpendicular to the first horizontal direction so as to cut the workpiece strips into workpiece blocks. The support plates are configured to rotate the workpiece blocks, and the second sandblasting assembly is further configured for processing the workpiece blocks into cylindrical workpieces while the support plates rotate the workpiece blocks.

20 Claims, 9 Drawing Sheets

SANDBLASTING APPARATUS

BACKGROUND

1. Technical Field

The present disclosure relates to cylindrical grinding technology, and particularly, to a sandblasting apparatus.

2. Description of Related Art

Many kinds of workpieces need to be ground to a desired shape before use. For example, optical lenses used in a digital camera are ground to a desired shape and size to allow their installation into lens barrels. Generally, a cylindrical grinding process includes the following steps: first, a number of original lenses having a rectangular shape are bonded together by ultraviolet glue to form a cuboid. Second, the cuboid is fixed on a fixing device and the original lenses are together ground to form a number of optical lenses. Third, the glue is removed to separate the optical lenses and the optical lenses are cleaned. However, the separating step and the cleaning step are time-consuming and thus costly. Further, it is difficult to ensure the glue is completely removed from the optical lenses, which can decrease the optical performance of the optical lenses.

Therefore, it is desirable to provide a sandblasting apparatus, which can overcome or at least alleviate the above-mentioned problems.

DETAILED DESCRIPTION

Figure 1:
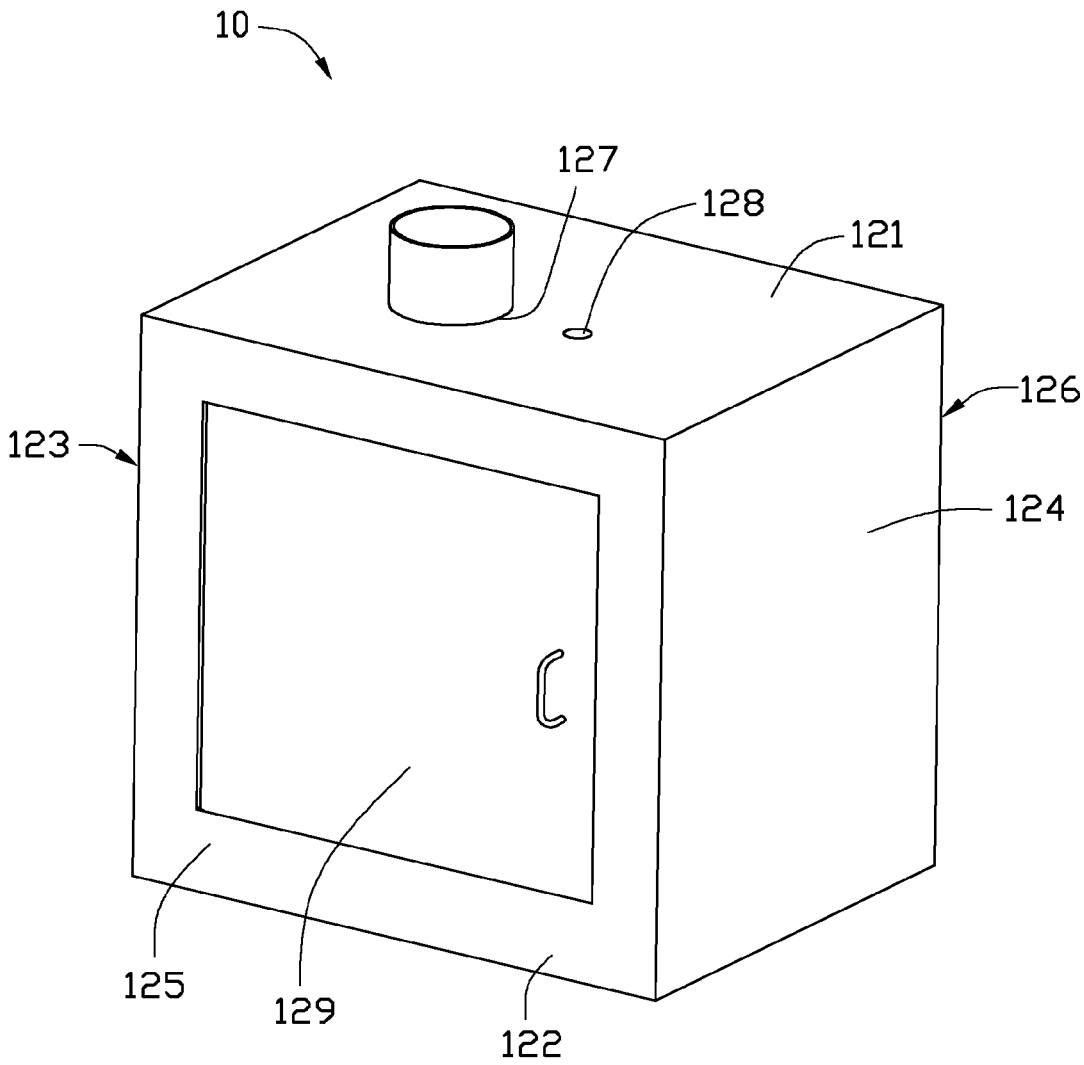
FIG. 1 is a schematic, isometric view of a sandblasting apparatus including a door, according to a first exemplary embodiment, showing the door closed.
Figure 5:
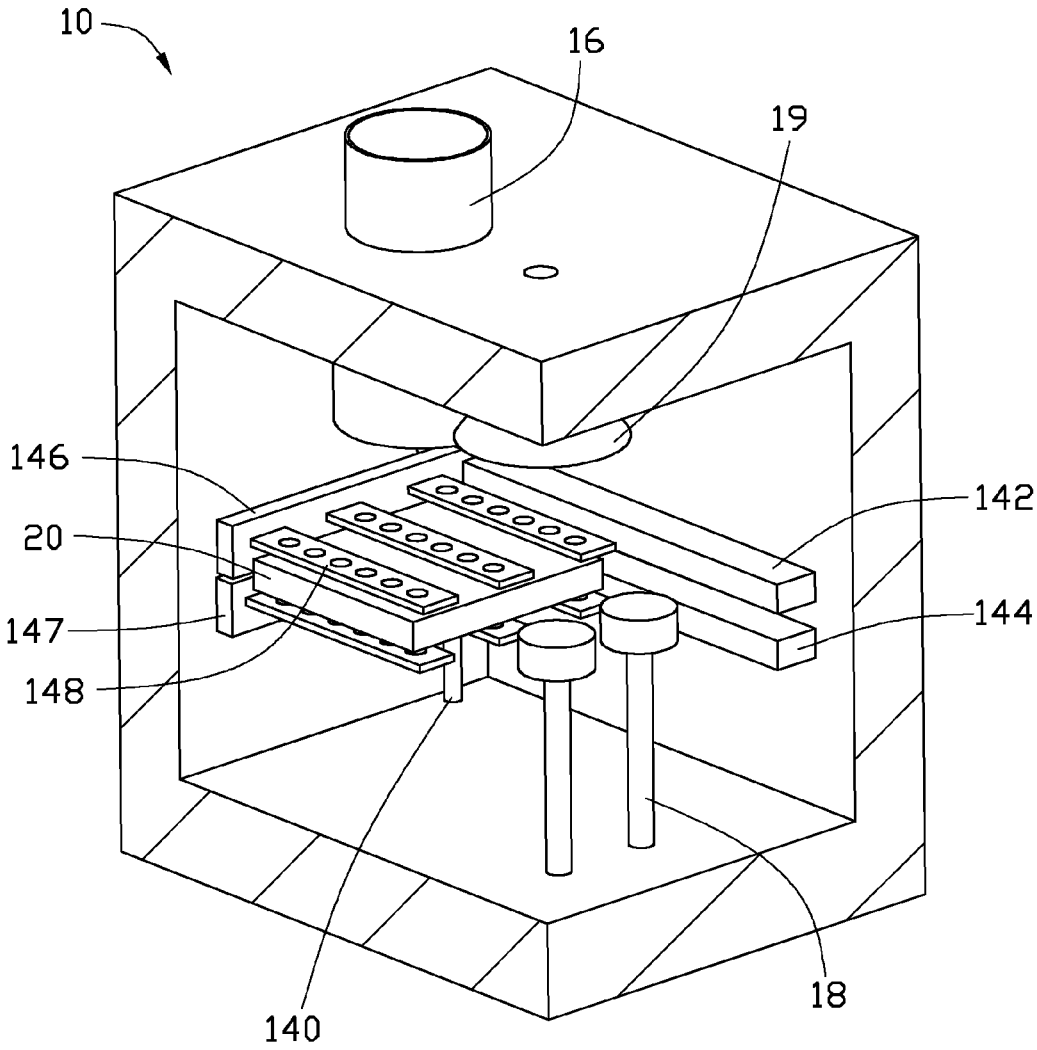
FIG. 5 shows a plate-shaped workpiece being held by a support assembly of the sandblasting apparatus of FIG. 3.
Figure 6:
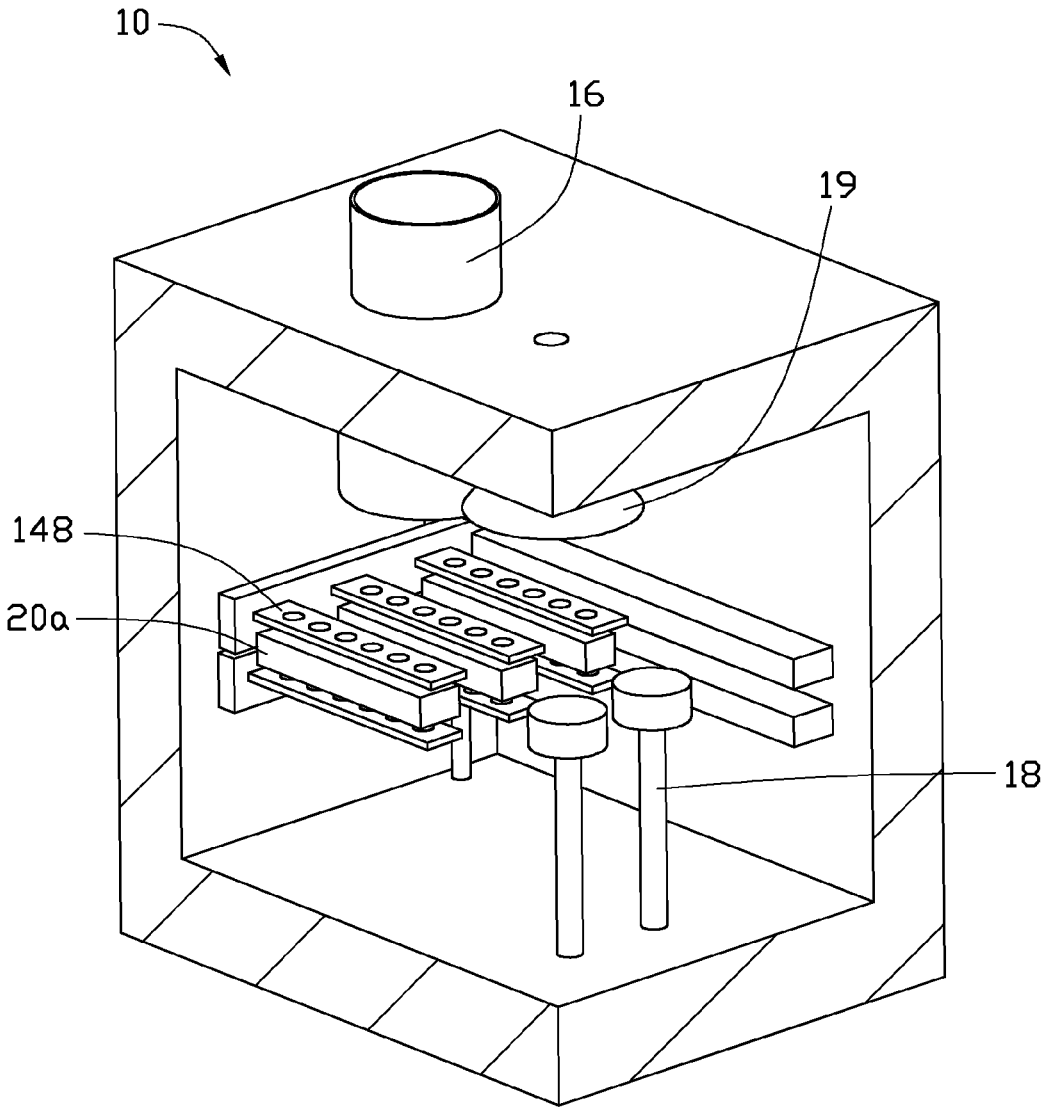
FIG. 6 shows the plate-shaped workpiece being cut into a plurality of workpiece stripes strips by a first sandblasting assembly of FIG. 3.
Figure 7:
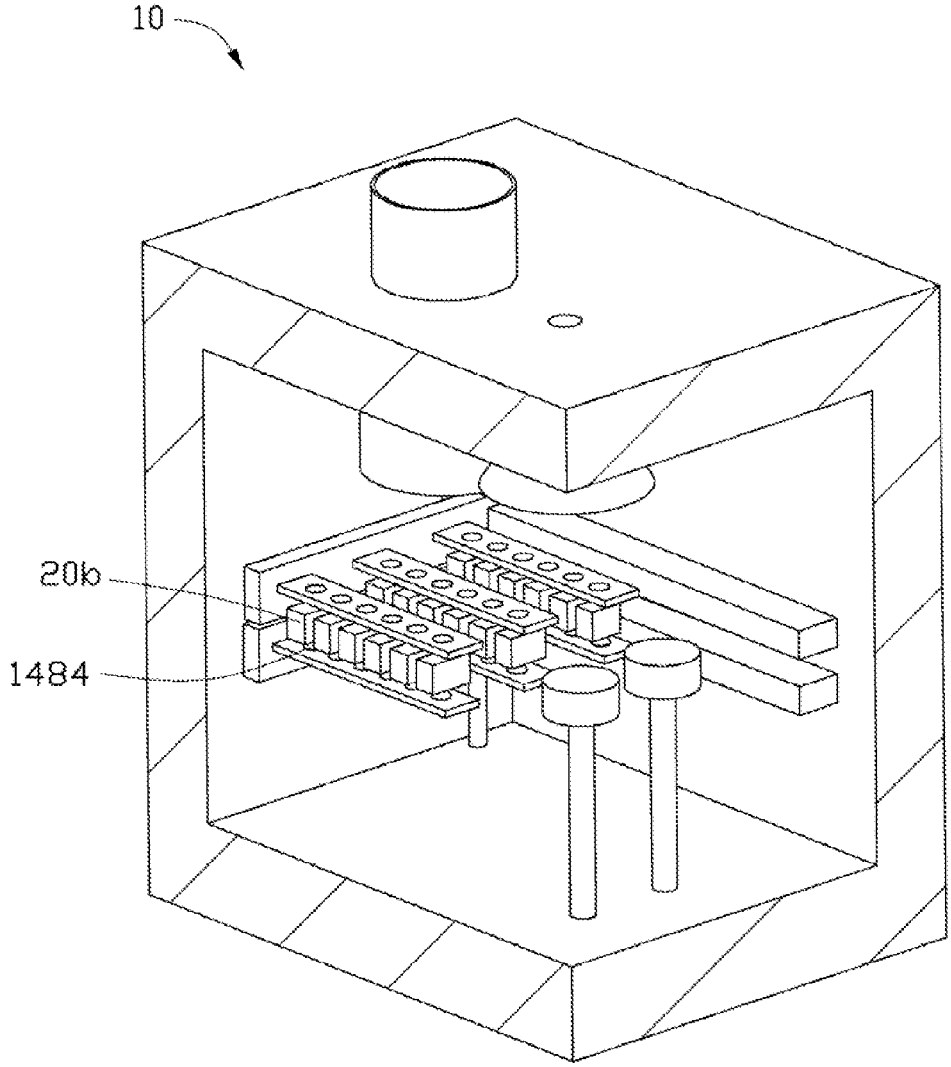
FIG. 7 shows the workpiece strips being cut into workpiece blocks by a second sandblasting assembly of FIG. 3.
Figure 8:
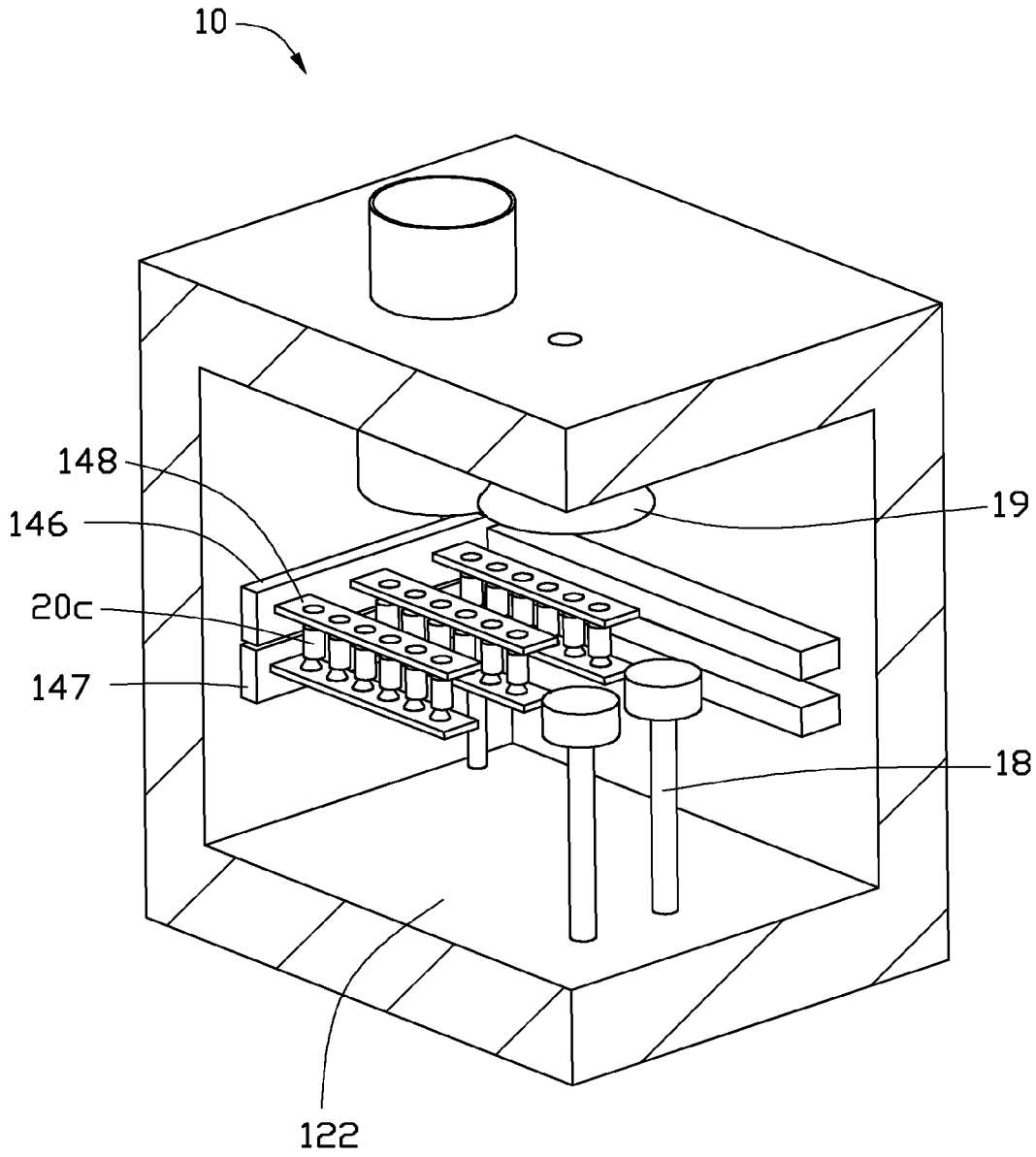

Referring to FIG. 1, a sandblasting apparatus 10, according to a first exemplary embodiment, is configured for cutting a plate-shaped workpiece 20 (shown in FIG. 5) into a number of workpiece strips 20*a* (shown in FIG. 6), cutting the workpiece strips 20*a* into a number of workpiece blocks 20*b* (shown in FIG. 7), and grinding the workpiece blocks 20*b* to form cylindrical workpieces 20*c* (shown in FIG. 8).

Figure 2:
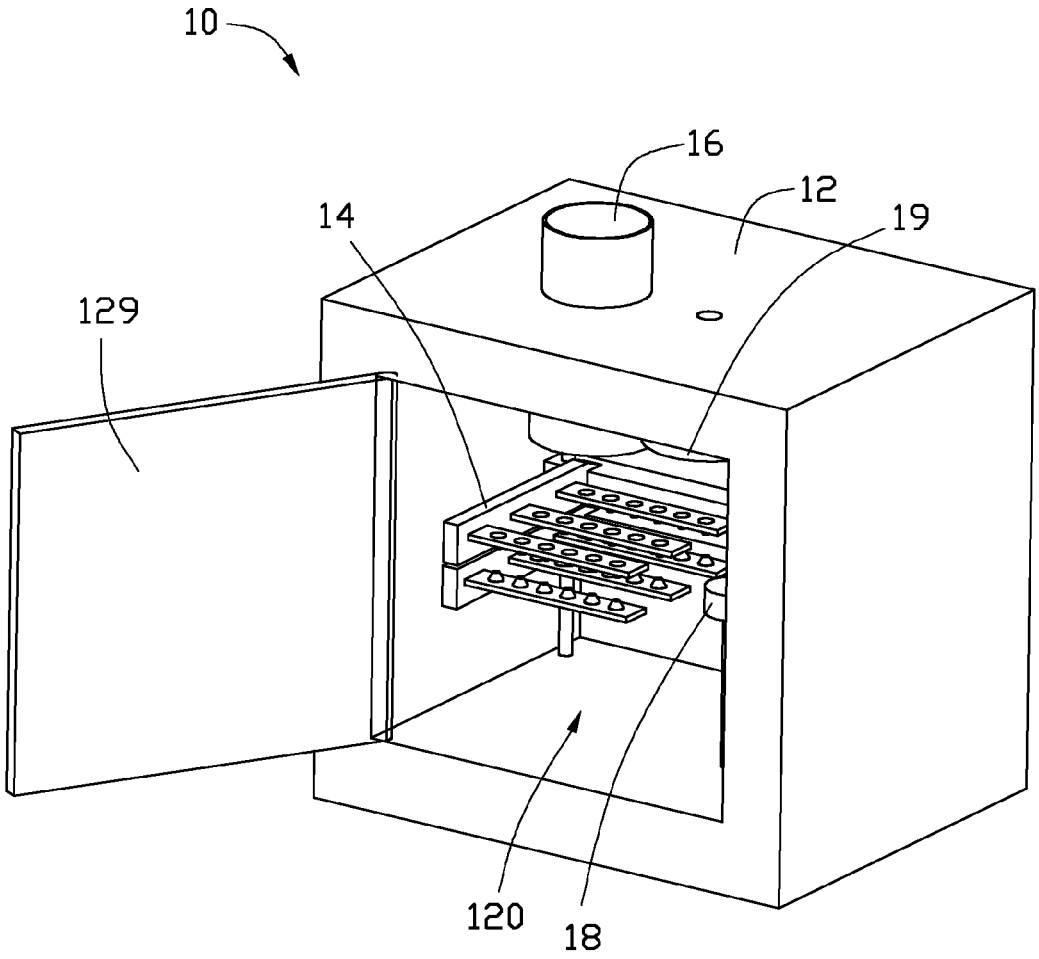
FIG. 2 is similar to FIG. 1, but showing the door open.
Figure 3:
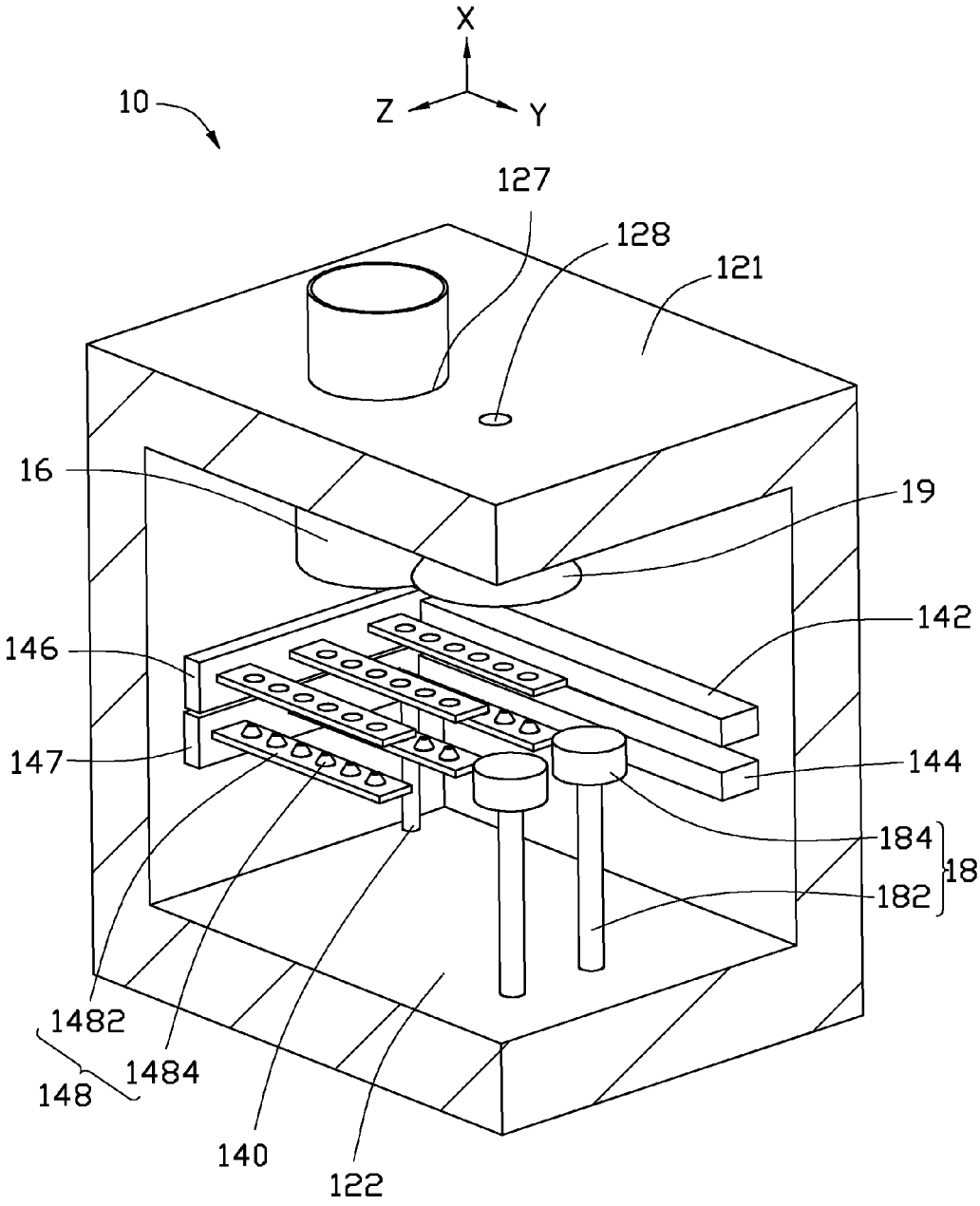
FIG. 3 is a cutaway view of the sandblasting apparatus of FIG. 1.
Figure 4:
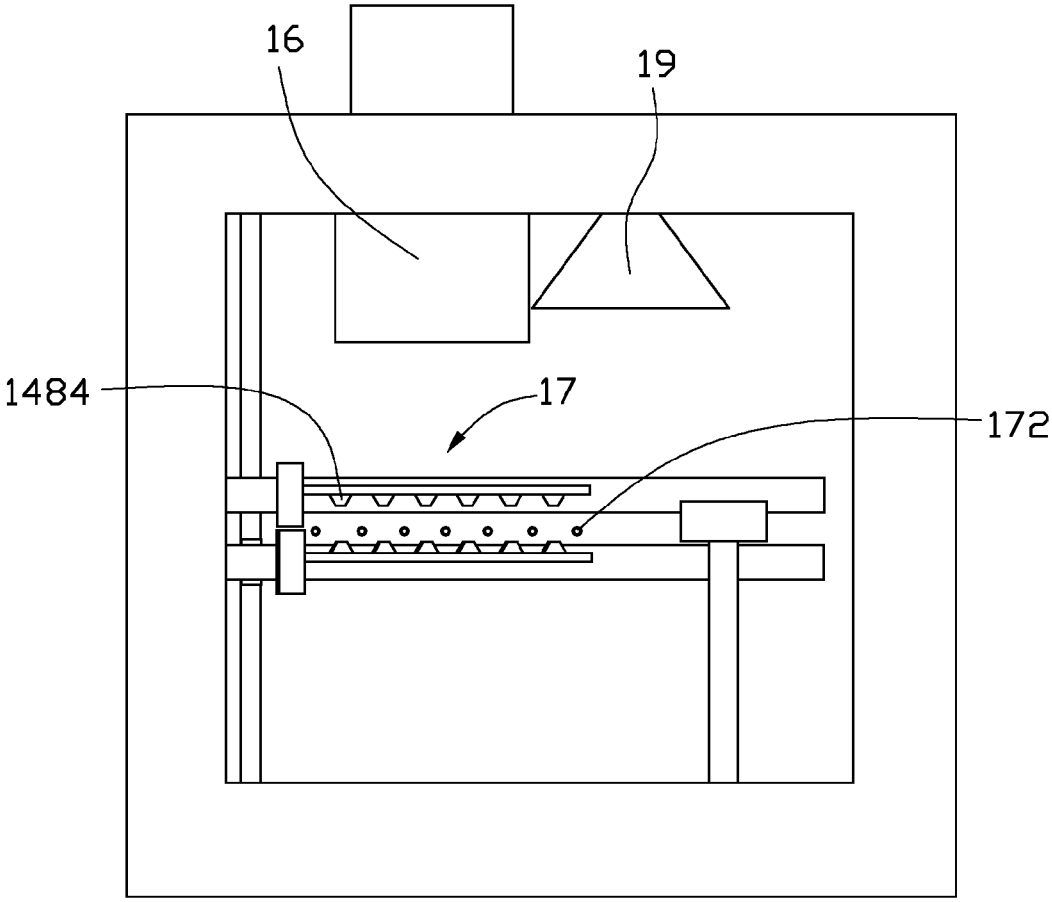
FIG. 4 is a planar view of the sandblasting apparatus of FIG. 1, with the door removed.

Referring to FIGS. 2-4, the sandblasting apparatus 10 includes a chamber 12, a support assembly 14, a first sandblasting assembly 16, a second sandblasting assembly 17, a grinding assembly 18, and an airflow-guiding assembly 19.

The chamber 12 is substantially cuboid and defines a cavity 120. The chamber 12 includes an upper wall 121, a lower wall 122, a left sidewall 123, a right sidewall 124, a front sidewall 125, and a back sidewall 126. The upper wall 121 is substantially parallel to the lower wall 122. The left sidewall 123 is substantially parallel to the right sidewall 124. The front sidewall 125 is substantially parallel to the back sidewall 126. The left sidewall 123, the front sidewall 125, the right sidewall 124 and the back sidewall 126 are connected to each other end-to-end. The left sidewall 123, the front sidewall 125, the right sidewall 124 and the back sidewall 126 connect the upper wall 121 to the lower wall 122. The front sidewall 121 defines a first through hole 127 and a second through hole 128 apart from the first through hole 127. A door 129 is attached to the front sidewall 125 and is configured for sealing or unsealing the cavity 120. The back sidewall 126 defines seven third through holes (not shown).

The support assembly 14 is received in the cavity 120 and includes a vertical supporting pole 140, a first hanging arm 142, a second hanging arm 144, a first moveable arm 146, a second moveable arm 147, and three pairs of elongated support plates 148.

The supporting pole 140 perpendicularly connects the upper wall 121 to the lower wall 122. A longitudinal direction of the supporting pole 140 is defined as a vertical direction (shown as X axis).

One end of the first hanging arm 142 is moveably and perpendicularly connected to the supporting pole 140, and other portion of the first hanging arm 142 is free. A longitudinal direction of the first hanging arm 142 is defined as a first horizontal direction (shown as Y axis).

One end of the second hanging arm 144 is moveably and perpendicularly connected to the supporting pole 140, and other portion of the second hanging arm 144 is free. The first hanging arm 142 is substantially parallel to the second hanging arm 144 and apart from the second hanging arm 144. The first and second hanging arms 142, 144 can move along the vertical direction.

One end of the first moveable arm 146 is moveably and perpendicularly connected to the first hanging arm 142, and other portion of the first moveable arm 146 is free. The first moveable arm 146 can move along the first horizontal direction. A longitudinal direction of the first moveable arm 146 is defined as a second horizontal direction (shown as Z axis). The second horizontal direction is perpendicular to the first horizontal direction.

One end of the second moveable arm 147 is moveably and perpendicularly connected to the second hanging arm 144, and other portion of the second moveable arm 147 is free. The second moveable arm 147 can move along the first horizontal direction.

The support plates 148 are parallel to each other. Three support plates 148 are connected to the free portion of the first moveable arm 146, the other three support plates 148 are connected to the free portion of the second moveable arm 147. The three support plates 148 connected to the first moveable arm 146 are respectively vertically aligned with the three support plates 148 connected to the second moveable arm 147.

Each support plate 148 includes a body portion 1482 and six rotatable members 1484 arranged on a same side of the body portion 1482. The rotatable members 1484 of each pair of support plates 148 are paired and vertically aligned. The paired rotatable members 1484 are configured for clamping the workpiece blocks 20*b* therebetween.

The first sandblasting assembly 16 is positioned on the upper wall 121. The first sandblasting assembly 16 extends through the first through hole 127 and enters the cavity 120. A portion of the first sandblasting assembly 16 outside the chamber 12 is connected to a first sand supplying unit (not shown). A portion of the first sandblasting assembly 16 inside the chamber 12 is opposite to the support assembly 14. The first sandblasting assembly 16 is configured for cutting the plate-shaped workpiece 20 into a number of workpiece strips 20*a* by spraying sand downwardly toward the plate-shaped workpiece 20 along the vertical direction.

The second sandblasting assembly 17 includes seven spray nozzles 172. The seven spray nozzles 172 are arranged in a line on the back sidewall 126 along the first horizontal direction. The spray nozzles 172 pass through the third through holes (not shown) respectively and enter the cavity 120. A portion of each spray nozzle 172 outside the chamber 12 is connected to a second sand supplying unit (not shown). A portion of each spray nozzle 172 inside the chamber 12 is opposite to the plate-shaped workpiece 20. Each spray nozzle 172 is misaligned with the rotatable members 1484 in the second horizontal direction. The second sandblasting assembly 17 is configured for spraying sand in the second horizontal direction to cut the workpiece strips 20*a* into a number of workpiece blocks 20*b* and grinding the workpiece blocks 20*b* to form cylindrical workpieces 20*c*.

The grinding assembly 18 is received in the cavity 120 and includes two rotatable rollers 182 and two wheels 184. The rotatable rollers 182 are rotatably mounted on the lower wall 122. The two wheels 184 are mounted on upper ends of the two rotatable rollers 182 respectively. Each wheel 184 is misaligned with the support plates 148 along the first horizontal direction. The grinding assembly 18 is configured for removing rough edges of the cylindrical workpieces 20*c* to form final workpieces (not shown).

In other embodiments, two guiding passages (not shown) along the first horizontal direction may be defined in the lower wall 122. The grinding assembly 18 is mounted in the guiding passages. The grinding assembly 18 moves toward the support plates 148 along the first horizontal direction and rotates.

The airflow-guiding assembly 19 is positioned on the upper wall 121 and apart from the first sandblasting assembly 16. The airflow-guiding assembly 19 passes through the second through hole 128 and enters the cavity 120. A portion of the airflow-guiding assembly 19 exposing from the chamber 12 is connected to an air supplying unit such as a fan (not shown). A portion of the airflow-guiding assembly 19 inside the chamber 12 is opposite to the support plates 148. The airflow-guiding assembly 19 is configured for cleaning the support plates 148 with airflow.

Referring to FIGS. 5-8, a method for grinding a plate-shaped workpiece 20, using the sandblasting apparatus 10, includes the following steps.

The plate-shaped workpiece 20 is fixedly supported by the support assembly 14. In detail, the plate-shaped workpiece 20 is sandwiched between the three support plates 148 connected to the first moveable arm 146 and the three support plates 148 connected to the second moveable arm 147.

The first moveable arm 146 and the second moveable arm 147 are then moved together along the first horizontal direction (back and forth) to position the plate-shaped workpiece 20 below the first sandblasting assembly 16.

The first hanging arm 142 and the second hanging arm 144 are then moved together along the vertical direction (up and down) to align the space between two neighboring rotatable members 1484 in a same support plate 148 with the second sandblasting assembly 17 in the second horizontal direction.

Then the door 129 is closed.

The plate-shaped workpiece 20 is cut into a number of workpiece strips 20*a* by spraying sand downwardly toward the plate-shaped workpiece 20 along the vertical direction.

The workpiece strips 20*a* are then cut into workpiece blocks 20*b* by spraying sand in the second horizontal direction.

The workpiece blocks 20*b* are then rotated with rotation of the rotatable members 1484 and are ground to form cylindrical workpieces 20*c* by simultaneously spraying sand in the second horizontal direction.

The cylindrical workpieces 20*c* are ground to remove rough edges to form final workpieces (not shown) by the grinding assembly 18. In detail, the wheels 184 rotate with rotation of the rotatable rollers 182. The first and second moveable arms 146, 147 move toward the grinding assembly 18 until the wheels 184 contact each cylindrical workpiece 20*c*.

In other embodiments, if two guiding passages (not shown) along the first horizontal direction are defined in the lower wall 122. The grinding assembly 18 is mounted in the guiding passages. The grinding assembly 18 moves toward the support plates 148 along the first horizontal direction and rotates until the wheels 184 contact each cylindrical workpiece 20*c*.

The support plates 148 are cleaned by airflow blown from the air-flow guiding assembly 19.

The door 129 is opened and the final workpieces are removed from the chamber 12.

During the above cylindrical grinding process, glue is not needed, thus eliminating the need for the separating step and glue cleaning step. This saves time and money, and ensures a quality product. Further, the sand sprayed by the first sandblasting assembly 16 and the second sandblasting assembly 17 and cutting scrap of the plate-shaped workpieces 20 are blocked by the door 129, which protects the operator.

Figure 9:
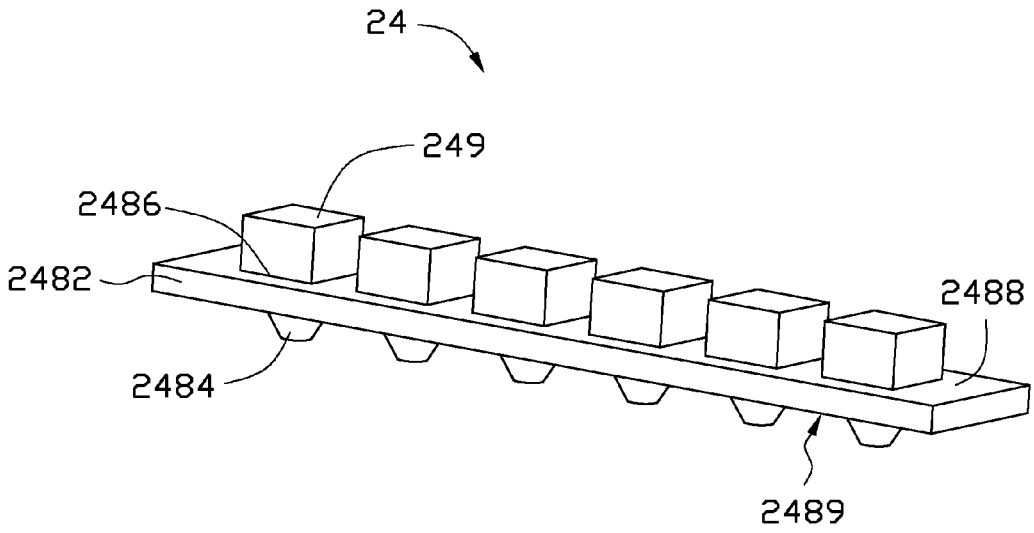

Referring to FIG. 9, a support assembly 24 of a sandblasting apparatus, according to a second exemplary embodiment, is shown. The differences between the support assembly 24 of the second exemplary embodiment and the support assembly 14 of the first exemplary embodiment are: the support assembly 24 includes three pair of support plates 248 and a number of driving members 249. Each support plate 248 includes a body portion 2482 and six rotatable members 2484. The body portion 2482 includes a first surface 2488 and a second surface 2489 opposite to the first surface 2488. The body portion 2482 defines six through holes 2486 corresponding to the six rotatable members 2484 and the driving member 249. Each driving member 249 is mounted on the first surface 2488 and extends through the corresponding through hole 2486 to connect the corresponding rotatable member 2484. The driving member 249 is configured for driving the corresponding rotatable member 2484 to rotate. In this embodiment, the driving member 249 is a motor.

The advantages of the sandblasting apparatus of the second exemplary embodiment are similar to those of the sandblasting apparatus 10 of the first exemplary embodiment.

It is to be understood, however, that even though numerous characteristics and advantages of the present embodiments have been set forth in the foregoing description, together with details of the structures and functions of the embodiments. The disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A sandblasting apparatus, comprising:

a chamber defining a cavity;

a support assembly received in the cavity, the support assembly comprising a plurality of pairs of elongated support plates for holding a plate-shaped workpiece therebetween, the support plates being moveable along a vertical direction and a first horizontal direction;

a first sandblasting assembly configured for spraying sand downwardly toward the plate-shaped workpiece so as to cut the plate-shaped workpiece into a plurality of workpiece strips;

a second sandblasting assembly configured for spraying sand toward the workpiece strips along a second horizontal direction perpendicular to the first horizontal direction so as to cut the workpiece strips into workpiece blocks; wherein the support plates are configured to rotate the workpiece blocks, and the second sandblasting assembly is further configured for processing the workpiece blocks into cylindrical workpieces while the support plates rotate the workpiece blocks.

2. The sandblasting apparatus as claimed in claim 1, wherein the first sandblasting assembly is configured for spraying the sand along the vertical direction.

3. The sandblasting apparatus as claimed in claim 2, wherein the support plates are parallel to each other.

4. The sandblasting apparatus as claimed in claim 3, wherein the support assembly further comprises a vertical supporting pole, two hanging arms, and a pair of moveable arms, the hanging arms are moveably connected to the supporting pole and apart from each other, the moveable arms are moveably connected to the hanging arms respectively, the moveable arms are oriented in the second horizontal direction, each pair of the support plates is fixedly connected to the moveable arms, and each pair of the support plates are vertically aligned with each other.

5. The sandblasting apparatus as claimed in claim 4, wherein each support plate comprises a body portion and a plurality of rotatable members on a same side of the body portion, the rotatable members of each pair of support plates are paired and vertically aligned, and the paired rotatable members are configured for clamping the workpiece blocks therebetween.

6. The sandblasting apparatus as claimed in claim 5, wherein the second sandblasting assembly comprises a plurality of spray nozzles arranged in a line along the first horizontal direction, and the spray nozzles are misaligned with the rotatable members in the second horizontal direction.

7. The sandblasting apparatus as claimed in claim 4, wherein the support assembly further comprises a plurality of driving members, the support plate comprises a body portion and a plurality of rotatable members corresponding to the driving members, the rotatable members and the driving members are positioned at opposite sides of the body portion, and the driving members are configured for driving the corresponding rotatable members to rotate.

8. The sandblasting apparatus as claimed in claim 4, further comprising a grinding assembly, wherein the grinding assembly comprises a plurality of rotatable rollers and a plurality of wheels mounted on the rotatable rollers, and the wheels are misaligned with the support plates along the first horizontal direction.

9. The sandblasting apparatus as claimed in claim 8, wherein the grinding assembly is moveable along the first horizontal direction in the cavity.

10. The sandblasting apparatus as claimed in claim 4, further comprising an airflow-guiding assembly, wherein the airflow-guiding assembly is configured for blowing air toward the support plates.

11. The sandblasting apparatus as claimed in claim 10, wherein the chamber comprises an upper wall, a lower wall opposite to the upper wall, a front wall, and a back wall opposite to the front wall, the front wall and the back wall are interconnected between the upper wall and the lower wall, the supporting pole is interconnected between the upper wall and the lower wall, a longitudinal direction of the supporting pole is defined as the vertical direction, one end of each of the hanging arms is moveably and perpendicularly connected to the supporting pole, the other end of each of the hanging arms is free, a longitudinal direction of each of the hanging arms is defined as the first horizontal direction, one end of each of the moveable arms is moveably and perpendicularly connected to the corresponding hanging arm, the other end of each of the moveable arms is free, and a longitudinal direction of each of the moveable arms is defined as the second horizontal direction.

12. The sandblasting apparatus as claimed in claim 11, wherein the first sandblasting assembly is positioned on the upper wall, the second sandblasting assembly is positioned on the back wall, and the airflow-guiding assembly is positioned on the upper wall and spaced apart from the first sandblasting assembly.

13. The sandblasting apparatus as claimed in claim 12, wherein a door is attached to the front wall and is configured for sealing or unsealing the cavity.

14. A sandblasting apparatus, comprising:

a chamber defining a cavity;

a support assembly received in the cavity, the support assembly comprising a plurality of pairs of elongated support plates for holding a plate-shaped workpiece therebetween, the support plates being moveable along a vertical direction and a first horizontal direction, each support plate comprising a body portion and a plurality of rotatable members on a same side of the body portion, the rotatable members of each pair of support plates being paired and vertically aligned;

a first sandblasting assembly configured for spraying sand downwardly toward the plate-shaped workpiece so as to cut the plate-shaped workpiece into a plurality of workpiece strips;

a second sandblasting assembly configured for spraying sand toward the workpiece strips along a second horizontal direction perpendicular to the first horizontal direction so as to cut the workpiece strips into workpiece blocks; wherein the paired rotatable members are configured to clamp and rotate the workpiece blocks, and the second sandblasting assembly is further configured for processing the workpiece blocks into cylindrical workpieces while the rotatable members rotate the workpiece blocks.

15. The sandblasting apparatus as claimed in claim 14, wherein the first sandblasting assembly is configured for spraying the sand along the vertical direction.

16. The sandblasting apparatus as claimed in claim 15, wherein the support plates are parallel to each other.

17. The sandblasting apparatus as claimed in claim 14, wherein the second sandblasting assembly comprises a plurality of spray nozzles arranged in a line along the first horizontal direction, and the spray nozzles are misaligned with the rotatable members in the second horizontal direction.

18. The sandblasting apparatus as claimed in claim 17, further comprising a grinding assembly, wherein the grinding assembly comprises a plurality of rotatable rollers and a plurality of wheels mounted on the rotatable rollers, and the wheels are misaligned with the support plates along the first horizontal direction.

19. The sandblasting apparatus as claimed in claim 18, wherein the grinding assembly is moveable along the first horizontal direction in the cavity.

20. The sandblasting apparatus as claimed in claim 19, further comprising an airflow-guiding assembly, wherein the airflow-guiding assembly is configured for blowing air toward the support plates.

* * * * *